US005756911A

United States Patent [19]

Paterson

[11] Patent Number: 5,756,911

[45] Date of Patent: May 26, 1998

[54] MEANS AND METHOD FOR SOFTENING THE SOUND GENERATED BY A PIANO HAVING VERTICAL STRINGS

[76] Inventor: Timothy M. Paterson, 923 Douglas St., Apt. #203, Sioux City, Iowa 51101

[21] Appl. No.: 664,456

[22] Filed: Jun. 14, 1996

[51] Int. Cl.[6] ..... G10C 3/00

[52] U.S. Cl. ..... 84/220; 84/216; 84/222

[58] Field of Search ..... 84/216, 225, 219, 84/220, 217, 218, 222

[56] References Cited

U.S. PATENT DOCUMENTS

| | | | |
|---|---|---|---|
| 398,150 | 2/1889 | Hansing | 84/220 |
| 951,550 | 3/1910 | St. John | 84/217 |
| 1,483,104 | 2/1924 | McIlwrath | 84/219 |
| 2,751,804 | 6/1956 | Comparetti | 84/255 |
| 2,930,273 | 3/1960 | Magar | 84/255 |
| 4,198,893 | 4/1980 | Schimmel | 84/255 |
| 4,203,341 | 5/1980 | Takahashi | 84/255 |
| 4,306,483 | 12/1981 | Kobayashi | 84/255 |
| 5,239,907 | 8/1993 | Sugiyama et al. | 84/239 |
| 5,287,787 | 2/1994 | Satoshi | 84/240 |

OTHER PUBLICATIONS

American Piano Supply Co. (1981).

American Piano Supply Co., Catalog No. 96, circa 1993, p. 53 APSCO Piano Silencer, Clifton, New Jersey.

W. Robert Pierce, Pierce Piano Atlas, 8th Ed. 1989, pp. 1, 341–343, Long Beach, California.

*Primary Examiner*—Michael L. Gellner

*Assistant Examiner*—Shih-Yung Hsieh

*Attorney, Agent, or Firm*—Zarley, McKee, Thomte, Voorhees, & Sease

[57] ABSTRACT

A device for softening sounds generated by a piano includes a lifting rod assembly mounted on the frame of the piano and operatively connected with a soft pedal mounted on the frame. An elongated sound softening rail assembly is pivotally mounted on the frame for selectively mutingly engaging the strings. The sound softening rail assembly includes an elongated rail spaced above the hammers and at least one dampening wedge attached thereto extending transversely outward from the rail toward the strings. The lifting rod assembly engages the rail so as to pivot the rail when lifted by the soft pedal, thereby pivoting the dampening wedge into muting contact with at least one of the strings. A method of retrofitting an existing piano with this sound softening device is also disclosed.

11 Claims, 7 Drawing Sheets

MEANS AND METHOD FOR SOFTENING THE SOUND GENERATED BY A PIANO HAVING VERTICAL STRINGS

BACKGROUND OF THE INVENTION

The present invention relates to a means and method for softening the sound generated by a piano, more particularly, a piano having vertical strings.

The piano is a well known musical instrument in which hammers, operated from a keyboard through an assembly known as an action, strike upon metal strings to create sounds or musical notes. Various piano configurations are common. In one configuration, known as a grand piano, a harp-shaped body is supported so that the strings extend horizontally. However, in an upright configuration, the piano has a rectangular body or frame with strings extending vertically. The strings extend vertically in a conventional drop action piano as well.

A conventional upright piano action is shown in FIG. 1. The piano has a plurality of strings 10 mounted on a frame. The strings 10 are arranged into groups of one, two, or three adjacent strings. These groups are known as unisons.

Long one string unisons are generally found at the far left on the piano and are used to produce very low notes, tones or sounds. Shorter two string unisons are located not quite as far to the left and are generally used to produce slightly higher notes. And the even shorter three string unisons found elsewhere are generally used to produce even higher notes.

A hammer 12 is positioned in front of the strings of each unison, as is a damper assembly 14. Each damper assembly 14 includes a damper felt 16 that is normally in contact with its respective unison of strings 10.

An abstract or sticker 18 rests on each key 20 of the piano. The sticker 18 is pivotally connected to a wippen 22. The wippen 22 is also connected to a backcheck 24, a jack 26 and the damper assembly 14. When a player presses a key 20, the corresponding sticker 18 is forced upwardly and consequently raises and pivots the wippen 22 in a conventional manner such that the damper felt 16 is withdrawn from the strings 10. Meanwhile, the movement of the wippen 22 drives the jack 26 into the butt 28, and the backcheck 24 strikes the backstop 30 attached to the hammer butt 28. Thus, the hammer 12 is pivoted forward and strikes the undampened strings 10 to sound a musical note.

Sometimes the player desires to soften the sound of a note. FIGS. 1 and 2 also illustrate a conventional means and method for softening the sound generated by a piano having vertical strings 10. A soft pedal 32 is pivotally mounted to the frame by a fulcrum mechanism 34. Generally, the soft pedal 32 is the leftmost of three pedals (the other two pedals are not particularly relevant to this invention) mounted at the base of the piano between its ends so as to be easily reachable with the player's foot. One end of a lever arm 35 is connected to the end of the soft pedal 32 which is closest to the frame. The other end of the lever arm 35 extends to the end of the frame where it engages a lifting rod 36 such that the lifting rod is operatively connected with the soft pedal 32. As best seen in FIG. 2, when the pedal is depressed with a force A, the lifting rod is raised with a force B.

The lifting rod 36 extends upwardly and is substantially parallel to the strings 10. As is well known in the art, a key frame 38 extends from one end of the piano frame to the other. The lifting rod 36 extends through a vertical hole 40 disposed adjacent one end of the key frame 38 and continues upwardly between the end of the piano frame and the action

42 of the piano. The action 42 includes the hammer 12, damper assembly 14, sticker 18, wippen 22, backcheck 24, jack 26, backstop 30 and the key 20.

An elongated hammer rail 44 is pivotally mounted in supporting relation to the hammers 12 and extends horizontally between the ends of the frame. The upper end of the lifting rod 36 has a pin 46 protruding therefrom which engages the hammer rail 44 such that the hammer rail pivots with a direction C when the lifting rod is raised by the soft pedal 32 (see FIG. 2). As a result, the hammer rail 44 pivots or moves upwardly and toward the strings 10. Consequently, the hammer rail 44 urges the back of the hammer 12 forward (see movement arrow D in FIG. 2) about ⅝" closer to the strings 10. Thus, the distance between the hammer 12 and the strings 10 is decreased from D1 (about 1.875") to D2 (about 1.250"). The shorter striking distance results in a softer sound being generated by the piano when the hammer 12 strikes the strings 10. Unfortunately, in order to soften the sound, the hammer rail 44 must be operatively connected to the hammer 12 of the action 42.

One shortcoming of this operatively connected means for softening the sound of a piano is the phenomenon known as "lost motion" results. When the hammer rail 44 urges the back of the hammer 12 forward toward the strings 10, the hammer butt 28 and portions of the action 42 connected thereto also move. This movement leaves a gap L of about 3/32" between the jack 26 and the hammer butt 28. This gap or lost motion L is problematic because it can be felt by the player at the key 20. The key 20 must be depressed an initial distance to merely bring the jack 26 into engagement with the butt 28 of the hammer 12. Essentially, the player's finger feels no response from the rest of the action 42 until this lost motion is overcome. Thus, the key 20 initially feels "dead" and there is a slight delay before the rest of the action responds to the command given. This lost motion phenomenon is visually and tactually discernible because the front of the key 20 slumps slightly downward about 1/16" on the keyboard when the soft pedal 32 is depressed. Since the lost motion reduces the speed and efficiency with which the jack 26 contacts the hammer butt 28, the player's overall speed, continuity and smoothness of play can be adversely affected. Furthermore, the hammer butt 28 experiences higher forces and wears excessively.

Therefore, a primary object of the present invention is the provision of an improved means and method for softening sounds generated by a piano having a plurality of vertically mounted strings.

A further object of the present invention is the provision of a device for softening sounds generated by a piano without requiring connection to the action assembly of the piano.

A further object of the present invention is the provision of a lifting rod assembly that bypasses the hammers of the action assemblies.

A further object of the present invention is the provision of a device for softening sounds generated by a piano that includes an elongated sound softening rail assembly with dampening wedges for engaging the strings mounted thereon pivotally mounted to the frame above the hammers.

A further object of the present invention is the provision of a method for reducing lost motion while softening sound generated by a piano.

A further object of the present invention is the provision of a method of retrofitting an existing piano with a sound softening system that reduces lost motion.

A further object of the present invention is the provision of an improved sound softening device for a piano which is economical to manufacture, durable in use and simple in construction.

These and other objects of the present invention will be apparent from the description and claims which follow.

SUMMARY OF INVENTION

The present invention is a means and method of softening the sound generated by a piano having vertical strings struck by hammers. The sound softening device includes a lifting rod assembly mounted on the frame of the piano and operatively connected with a soft pedal. An elongated sound softening rail assembly is pivotally mounted on the frame for selectively mutingly engaging the strings.

The sound softening rail assembly includes an elongated rail spaced above the hammers and at least one dampening wedge attached thereto extending transversely outward from the rail toward the strings. The lifting rod assembly engages the rail so as to pivot the rail when lifted by the soft pedal, thereby pivoting the dampening wedge into muting contact with at least one of the strings.

Also disclosed is a method of retrofitting an existing piano with the sound softening device of this invention.

DETAILED DESCRIPTION OF THE PREFERRED EMBODIMENTS

Figure 1:
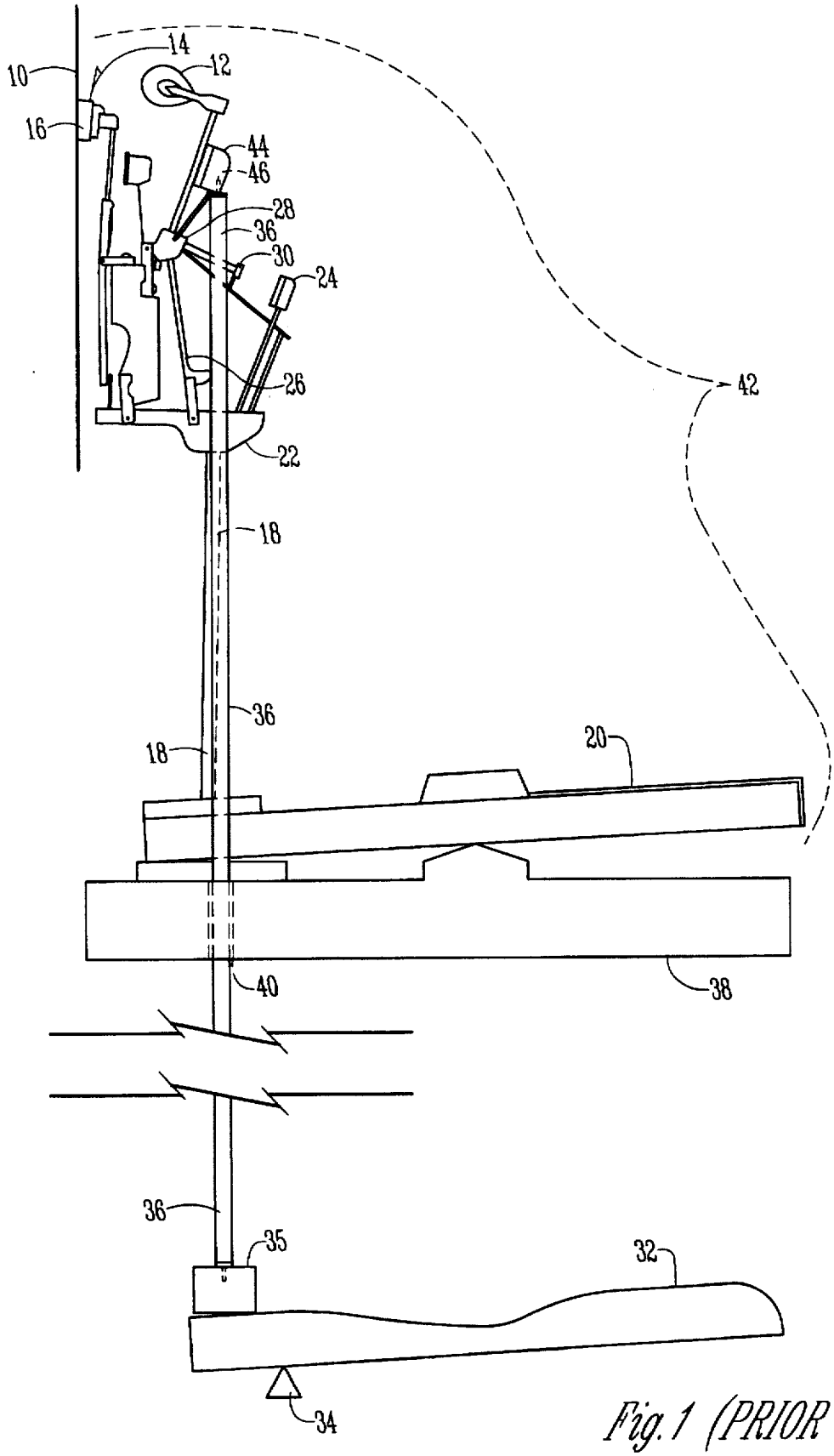
Fig. 1 (PRIOR ART)
FIG. 1 is an elevation view taken parallel to the strings and the end of a conventional piano.
Figure 2:
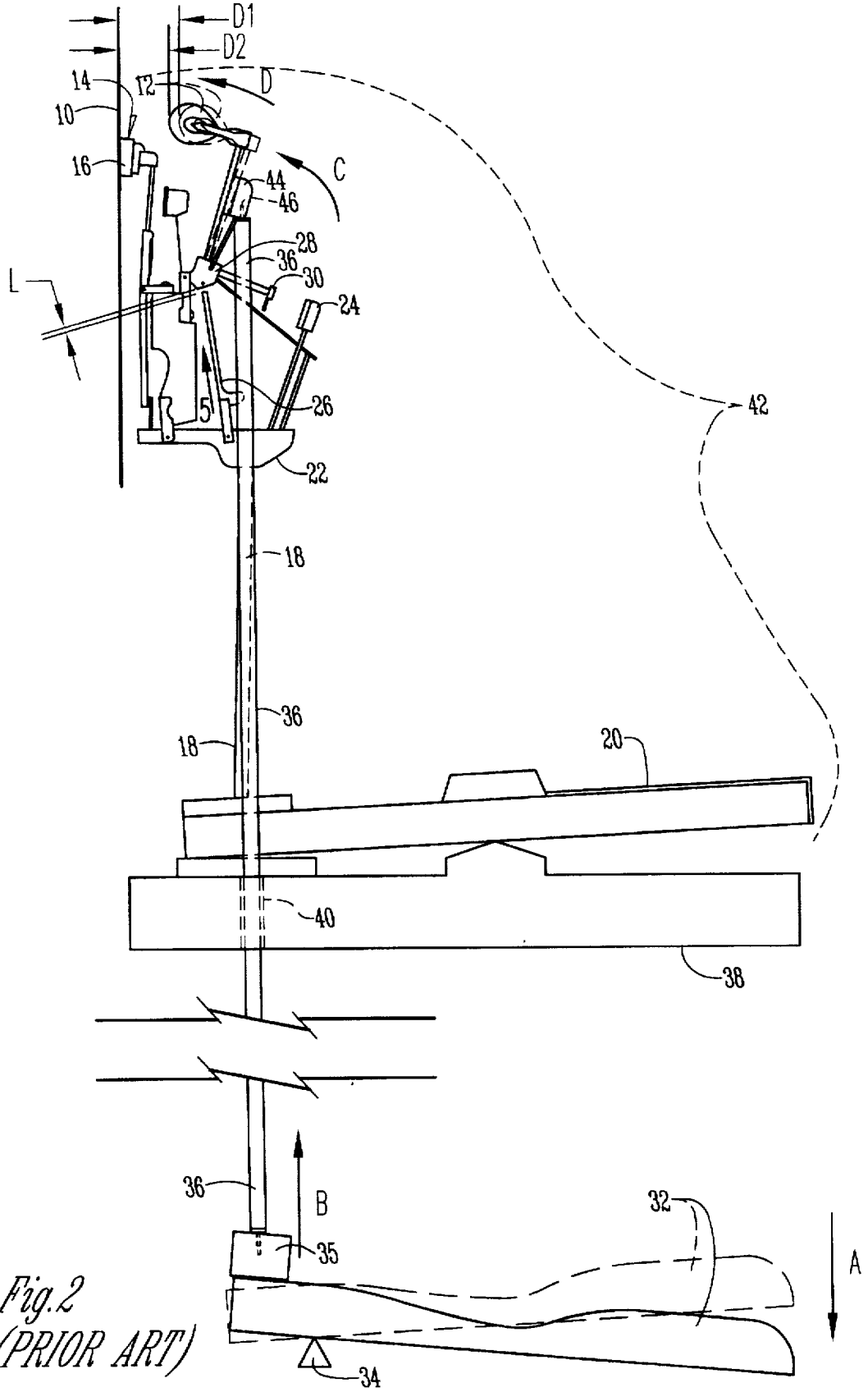
Fig.2 (PRIOR ART)
FIG. 2 is similar to FIG. 1, but shows the configuration of the piano action when the soft pedal is depressed and illustrates the phenomena of "lost motion" which affects the feel of the piano key to the pianist.
Figure 3:
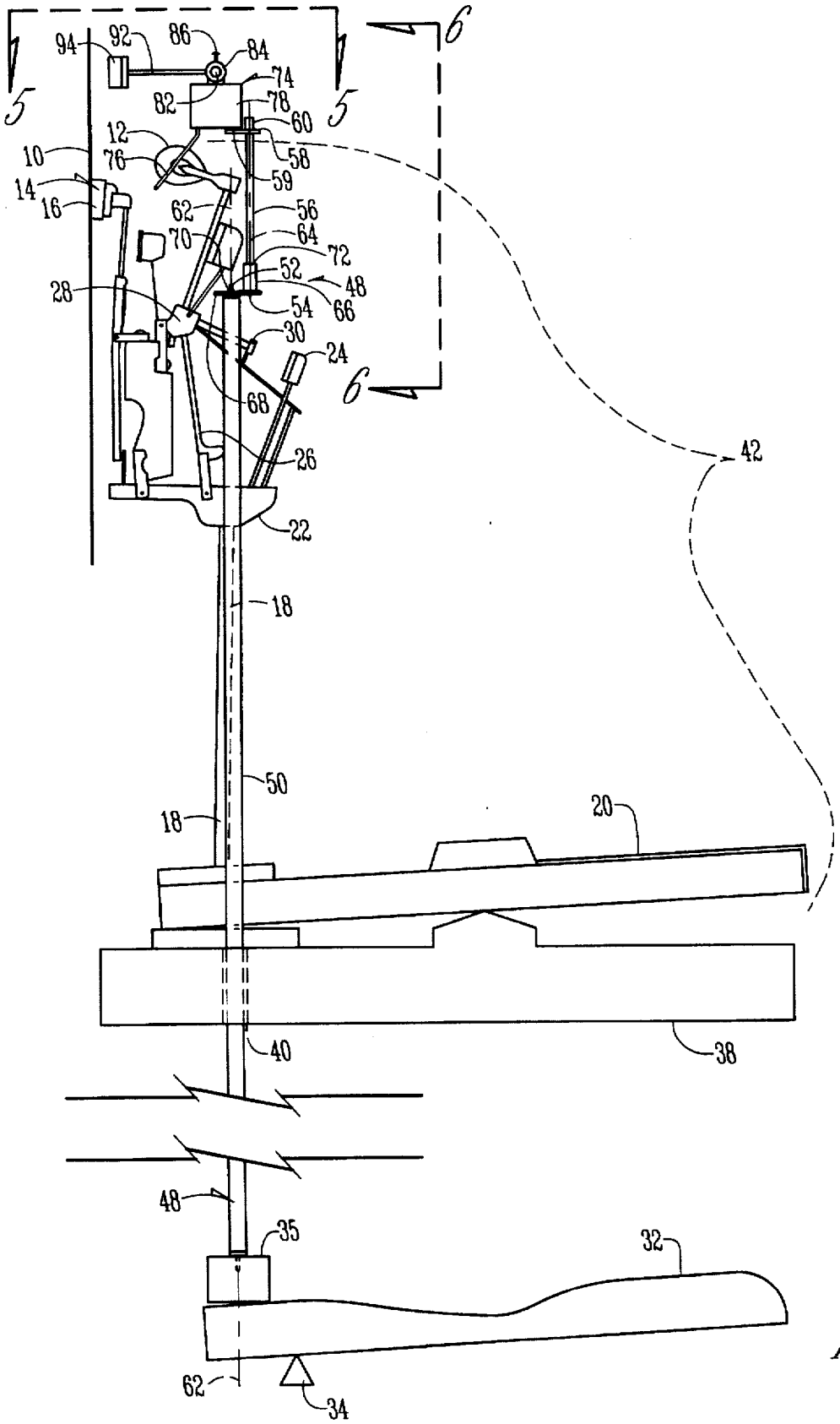
FIG. 3 is an elevation view similar to FIG. 1, but shows the present invention applied to the action of any piano having vertical strings.

The present invention is depicted in FIGS. 3–7. In FIG. 3, a soft pedal 32 has opposite ends and a central portion which is pivotally mounted to the frame 33 of the piano (see FIG. 7) so as to pivot on the fulcrum 34. The end of the soft pedal 32 that is closest to the frame 33 of the piano is conventionally connected to a lifting rod assembly 48 via a lever arm 35 extending from the central portion of the frame 33 to one of its ends.

The lifting rod assembly 48 includes a lower lifting rod 50 having a pin 52 protruding from the upper end thereof, an adapter 54, and an upper lifting rod 56 having one end held by the adapter 54 and another end having a laterally protruding holder 58 attached thereto. A cap 60 can also be provided at the upper end of the upper lifting rod 56 to secure the holder 58 in place. The cap 60 is secured to the rod 56 by conventional means, such as but not limited to threads.

The lower lifting rod 50 extends through a hole 40 in the key frame 38 in a conventional manner. However, the lower lifting rod 50 is preferably shorter than the lifting rod 36 of the prior art, such that the lifting rod assembly 48 is free of any connection with the action 42 of the piano. More precisely, because of the shorter lower lifting rod 50, the lifting rod assembly 48 is disconnected from the hammer rail 44. Therefore, the lifting rod assembly 48 is truly independent of the action 42 and the hammers 12 therein.

The lower lifting rod 50 has a central longitudinal axis 62. The pin 52 in the upper end of lifting rod 50 is preferably coaxial with the central axis 62. The upper lifting rod 56 has a central longitudinal axis 64 that is offset from and preferably parallel to axis 62 of the lower lifting rod 50. The offset between axis 62 and axis 64 allows the lifting rod assembly to be offset from or bypass the hammers 12 and the hammer rail 44.

The adapter 54 includes an upright barrel portion 66 and a flange portion 68 extending radially therefrom. The flange portion has a hole 70 therein for receiving the pin 52. The barrel portion 66 has an upwardly directed opening 72 therein for receiving the upper lifting rod 56. Thus, it can be seen from FIG. 3 that the upper lifting rod 56 is demountably mounted on the lower lifting rod 50 by the adapter 54.

The holder 58 is attached to the upper end of the upper lifting rod 56. The holder 58 extends laterally with respect to the rod 56. A cap 60 is placed over the upper end of the rod 56 to secure the holder 58 in place and prevent any axial movement of the holder 58 with respect to the lifting rod 56.

Figure 5:
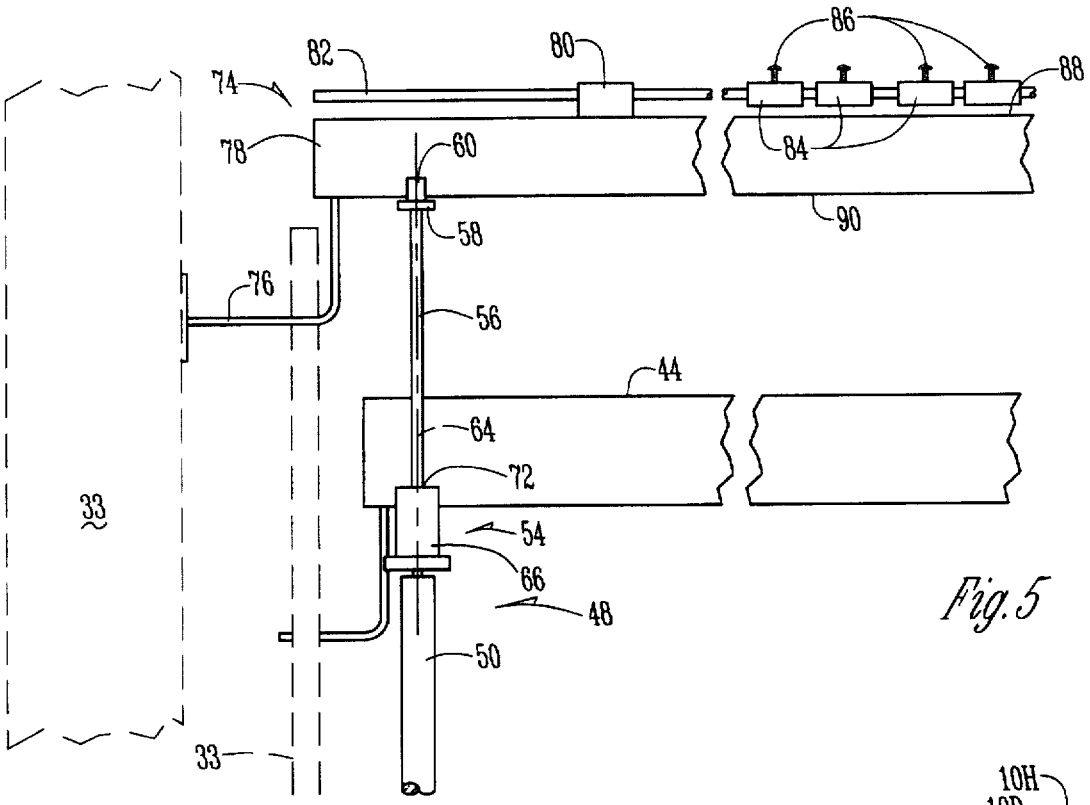
FIG. 5 is a partial front elevation view taken along line 5—5 in FIG. 3 and shows the sound softening rail assembly and the lifting rod assembly of the present invention with the hammers and the rest of the action of the piano omitted.
Figure 7:
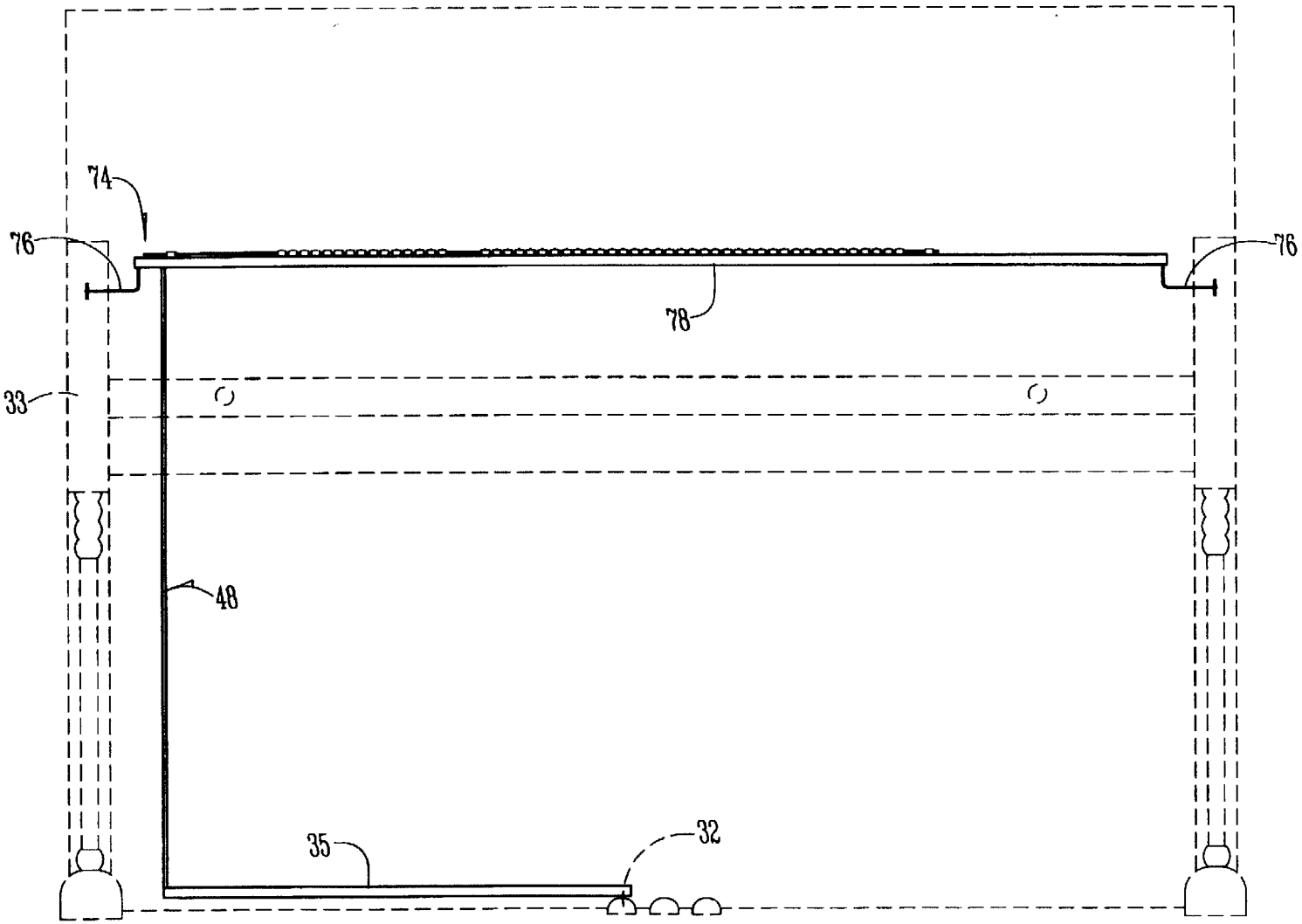
FIG. 7 is a front elevation view of the present invention installed in an upright piano.

As best seen in FIG. 7, a soft sound rail assembly 74 is pivotably mounted to the ends of the frame 33 of the piano by brackets 76. Referring to FIG. 5, the soft sound rail assembly 74 includes an elongated rail 78, at least one guide member 80 mounted along the soft sound rail 78 for receiving a containing rod 82. Spools 84 are installed on the containing rod 82 and are adjustably held in place by set screw mechanisms 86. Preferably the soft sound rail 78 is a parallelepiped body having opposite top and bottom surfaces 88 and 90 respectively. Preferably the guide member 80 is mounted on the top surface 88 of the soft sound rail 78.

Figure 6:
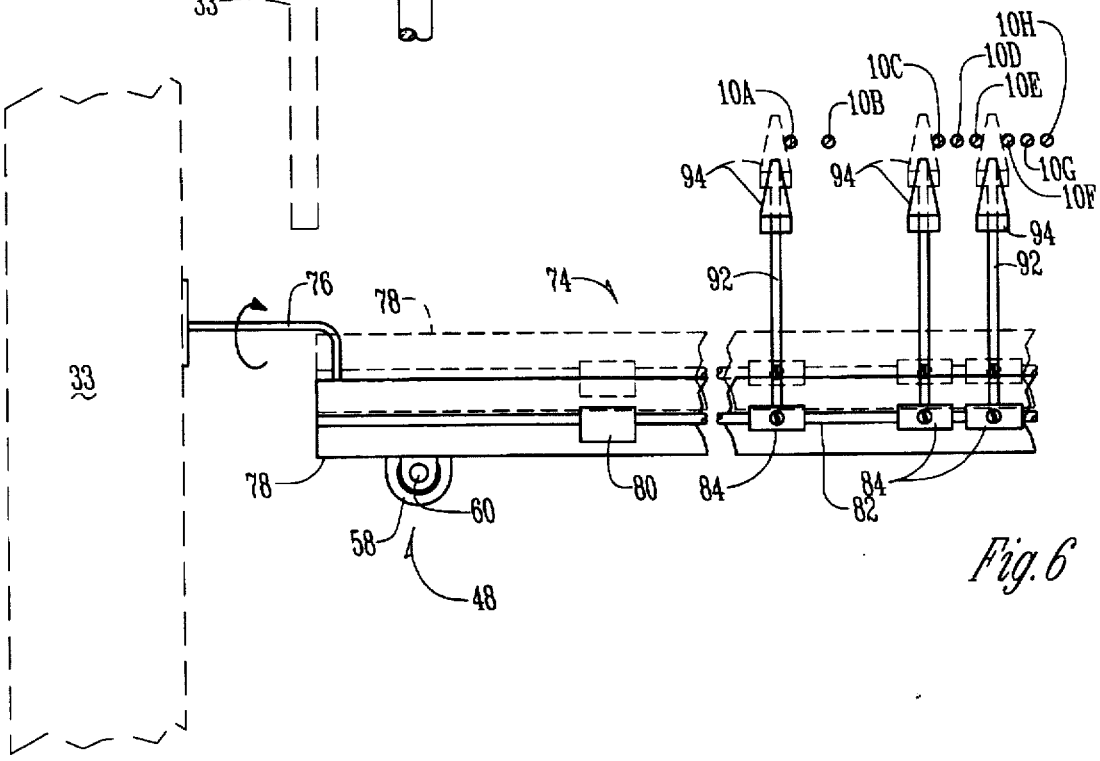
FIG. 6 is a top view of the sound softening system taken along line 6—6 in FIG. 3 and shows the relationship between the strings and the sound dampening wedges of the present invention.

The soft sound rail assembly 74 is mounted above the existing hammer rail 44 (FIG. 5) and the soft sound rail 78 is disposed above the hammers 12 (FIG. 3). As best seen in FIGS. 3 and 6, a rigid wire shank 92 has one end secured to a respective spool 84 for rotation therewith. A dampening wedge 94 is attached in a conventional, and preferrably adjustable, manner to the free end of the wire shank 92. Preferably the wire shanks 92 are substantially rigid so that they do not bend when the wedges 94 are pivoted into contact with strings 10. The dampening wedge 94 is constructed of conventional dampening material, such as piano damper felt or the like, and preferably has converging sides which define a truncated triangular horizontal cross section.

Figure 4:
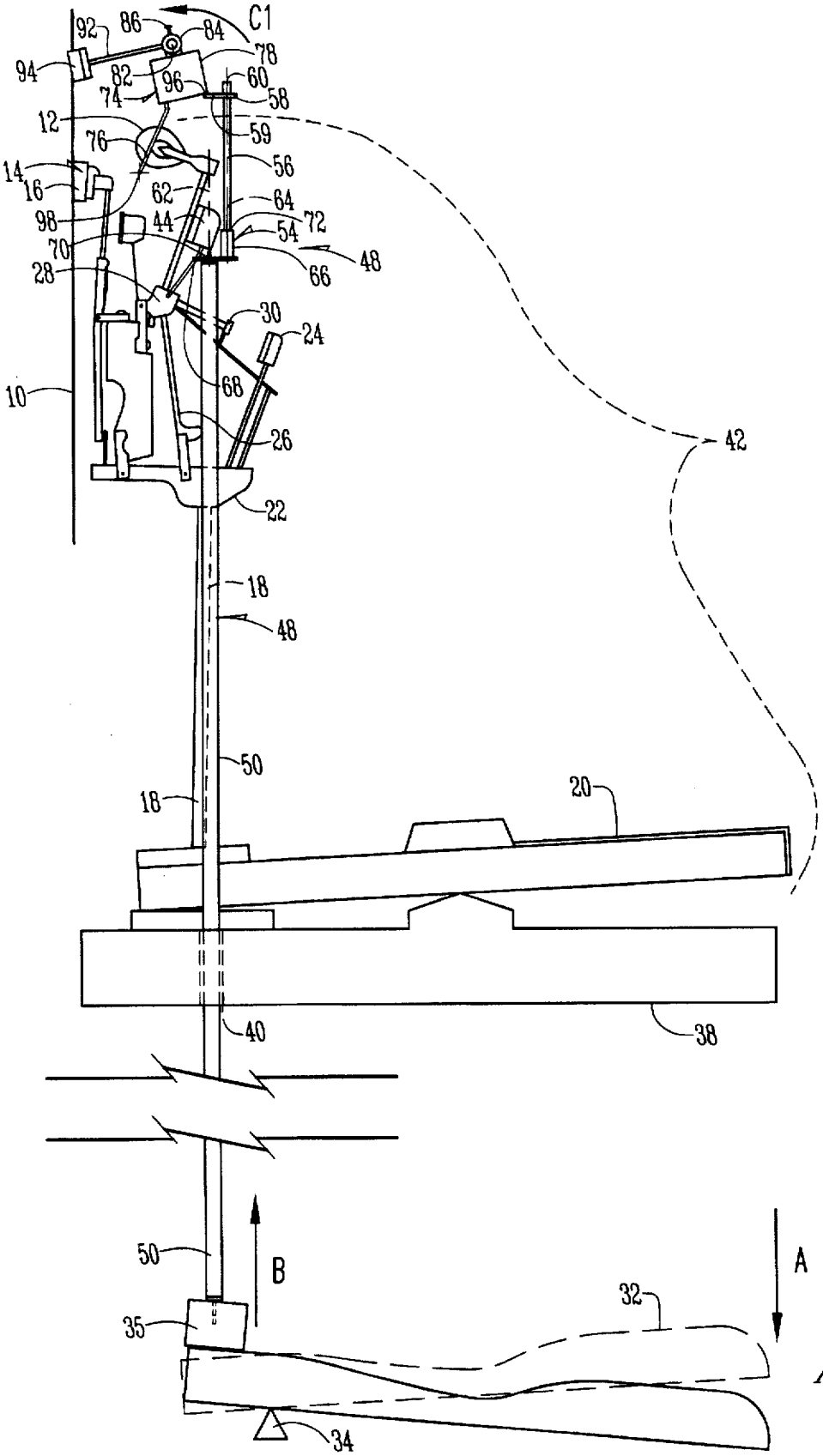
FIG. 4 is similar to FIG. 3, but shows how the present invention eliminates "lost motion" when the soft pedal is depressed.

The operation of the present invention is best understood in view of FIGS. 4, 6 and 7. In FIG. 4, the soft pedal 32 has been depressed by the player of the piano. The downward force on the pedal is indicated by the arrow A. As understood from FIGS. 4 and 7, the downward force A is translated into a upward force B on the lifting rod assembly 48. The lifting rod assembly 48 is thereby forced upward through the hole 40 in the key frame 38.

The tab 59 of the holder 58 engages the soft sound rail 78 at a contact area 96 that is offset from the pivotable axis 98 of the soft sound rail assembly 74. The upward force on the lifting rod assembly 48 cause the soft sound rail assembly 74 to pivot toward the strings 10 as indicated by the arrow C1. Thus, the dampening wedge 94 is pivoted into muting contact with at least one of the strings 10.

In this invention, the soft sound rail 78 is mounted above the hammers 12. In fact, the soft sound rail 78 is effectively disposed above the hammers 12 and thereby above the action 42 of the piano. Furthermore, the lifting rod assembly 48 and the soft sound rail assembly 74 are free of any connection with the action 42 of the piano and the hammers 12 in particular. Thus, the soft sound mechanism is independent of the hammers 12. Since the hammer rail 44 is disconnected from the lifting rod assembly 48 as shown in FIG. 4, no movement of the hammers 12 is necessary for softening the sound. Therefore, no lost motion results.

As best seen in FIG. 6, the present invention provides great flexibility for softening the sounds generated in two or three string unisons. As shown by the wedge 94 on the left in FIG. 6, a wedge can be pivoted into muting contact with the outside edge of one of the strings 10A of a two string unison comprising 10A and 10B. When the two string unison comprising strings 10A and 10B is struck by the corresponding hammer 12, string 10A is muted so that only string 10B is heard. The resulting sound is softer than if both strings 10A and 10B have been allowed to vibrate. The soft sound generated is similar to that of an acoustic guitar.

Similarly, as shown by the wedges 94 in the center and on the right in FIG. 6, wedges can also be pivoted into muting contact with the outside edges of a strings 10C and 10E of a three string unison comprising 10C, 10D and 10E. Thus, when the three string unison including 10C, 10D, and 10E is struck by the corresponding hammer 12, only the middle string 10D will be heard. Or a suitably sized wedge 94 can be pivoted between the outside edges of strings 10E and 10F of adjacent unisons. Of course, the wedges can also be sized and positioned so as to pivot between strings within a unison. It is also contemplated that the ends of the wedges could make muting contact with the front of the strings rather than the side contact shown.

FIGS. 5 and 6 illustrate that the spools 84 can be positioned along the containing rod 82 by loosening the set screw mechanisms 86. Once the spool 84 is in the desired new position, the set screw mechanism 86 can be retightened. It is also contemplated that the individual wedges 94 can be pivotally withdrawn from use by loosening the set screw mechanism 86 and rotating the spool about the containing rod 82 before retightening the set screw mechanism.

The present invention provides a method for reducing lost motion while softening the sound generated by a piano. Of course, when a new piano is built the structure discussed above can be provided. In that case, the lifting rod assembly 48 can comprise a single bent or crooked rod instead of separate lower and upper lifting rods 50 and 56. An adapter 54 would not be necessary.

However, there are many upright and drop action pianos that are already in use. One advantage of the present invention is that it can be readily applied or retrofitted on an existing piano. To accomplish the retrofit one merely pivotally mounts the sound softening rail assembly 74 to the frame 33. The soft sound rail 78 should extend transverse and adjacent to the strings 10 above the hammers 12. Then lifting rod 36 is disconnected from the hammer rail 44 and shortened so as to constitute lower lifting rod 50. Lifting rod 50 must be short enough to avoid engaging the hammer rail 44.

Next a bypass lifting rod assembly, including the adapter 54 and the upper lift rod 56 with the holder 58 and the cap 60 attached thereto is mounted on the upper end of the lower lifting rod 50. Together the lower lifting rod 50 and the bypass lifting rod assembly form an extended lifting rod assembly 48 that extends above the hammers 12. The lifting rod assembly 48 is engageable with the sound softening rail so as to rotate the sound softening rail and pivot the wedges 94 into contact with the strings 10 when the soft pedal 32 is depressed.

Thus, when soft sound is desired, the player presses the soft pedal 32 to pivot the wedges 94 into the strings 10 before striking a key 20. The player keeps his or her foot on the soft pedal 32 while striking the desired key 20 so as to generate a soft sound from the piano. The player releases the soft pedal 32 to return the sound of the piano to normal.

Figure 8:
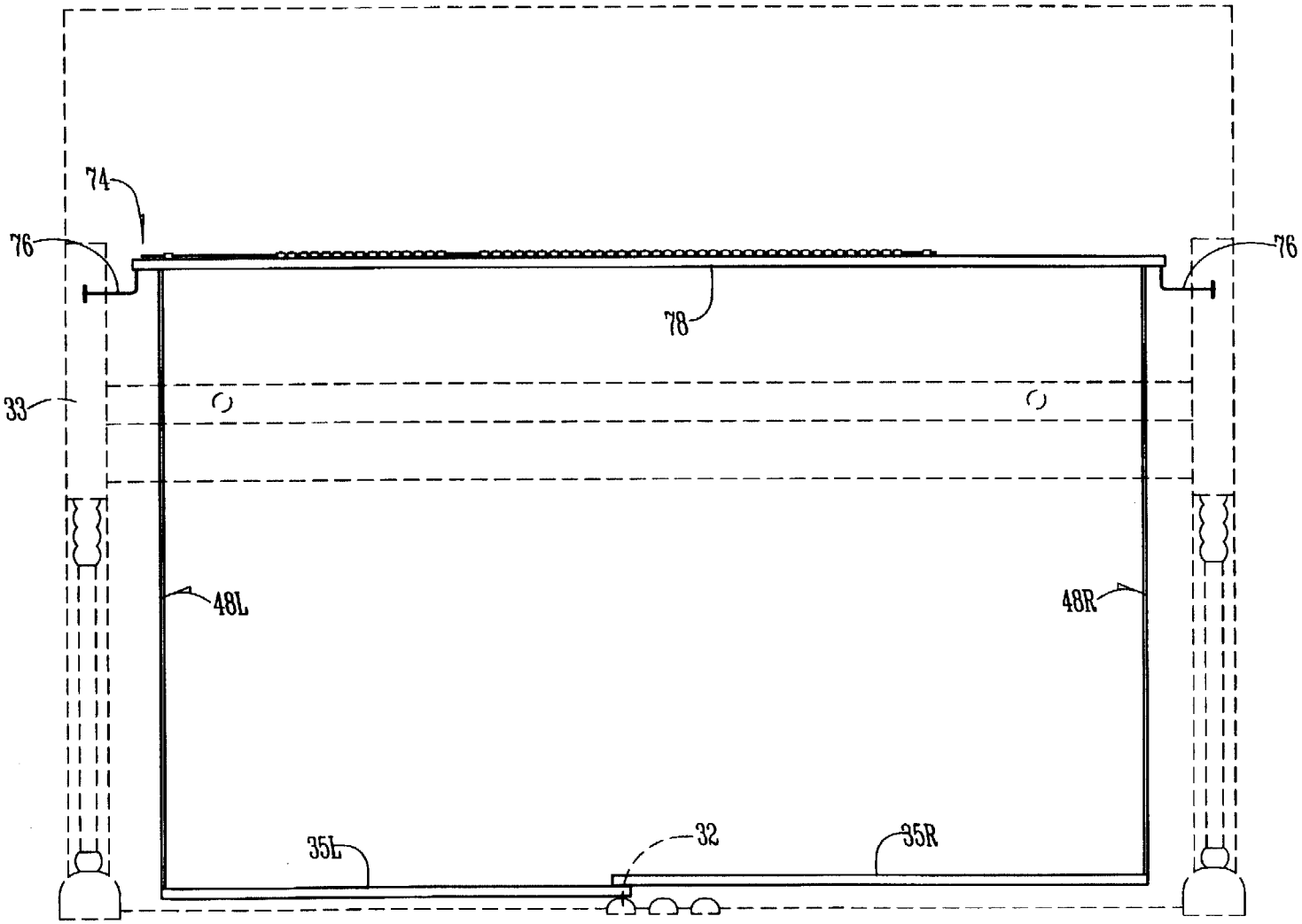
FIG. 8 is similar to FIG. 7, but shows a front elevation view of another embodiment of the present invention wherein lifting rod assemblies are provided at both ends of the piano to better support the soft sound rail.

Another embodiment of the present invention is shown in FIG. 8. To provide better support for the generally horizontal soft rail assembly 74, two identical lifting rod assemblies (as previously described) can be utilized, preferably one at either end of the piano. The left lifting rod assembly 48L is lifted and lowered by an arm 35L connected thereto and to the soft pedal 32. A right arm 35R also interconnects the soft pedal 32 with the right lifting rod assembly 48R so that depressing the former lifts the latter. Therefore, the two lifting rod assemblies 48R and 48L act in tandem to support and pivot the soft rail assembly.

Based upon the foregoing, the present invention at least accomplishes its stated objectives. It will be appreciated that the present invention can take many forms and embodiments. The true essence and spirit of this invention are defined in the appended claims, and it is not intended that the embodiment of the invention presented herein should limit the scope thereof.

What is claimed is:

1. A device for softening sounds generated by a piano having a frame supporting a plurality of strings mounted vertically thereon, a plurality of keys for selectively urging a corresponding plurality of hammers connected therewith to strike the strings, and a soft pedal having opposite ends and a central portion pivotally mounted to the frame, the device comprising:

a lifting rod assembly including a lower portion having a central longitudinal axis;

an upper portion having a central longitudinal axis; and an adapter extending generally transverse to both of said central longitudinal axes and joining the upper and lower portions together such that the central longitudinal axis thereof are laterally offset from each other and the central longitudinal axis of the upper portion is spaced apart from the hammers.

2. The device of claim 1 wherein the upper portion of the lifting rod assembly is demountably mounted on the lower portion by the adapter.

3. A device for softening sounds generated by a piano having a frame supporting a plurality of strings mounted vertically thereon, a plurality of keys for selectively urging a corresponding plurality of hammers connected therewith to strike the strings, and a soft pedal having opposite ends and a central portion pivotally mounted to the frame, the device comprising:

a lifting rod assembly mounted on the frame and operatively connected with one of the ends of the soft pedal, the lifting rod assembly being free of connection with the hammers at all times and thereby being independent thereof;

an elongated sound softening rail assembly pivotally mounted on the frame and including an elongated rail having a longitudinal axis and further including at least one dampening wedge mounted on the rail so as to extend outwardly therefrom toward the strings and generally transverse to the longitudinal axis, the rail being spaced above the hammers;

the lifting rod assembly engaging the rail so as to pivot the rail about the pivot axis, thereby pivoting the dampening wedge into muting contact with at least one of the strings when the other end of the pedal is depressed; and the lifting rod assembly including a rod having a first end with a holder having a base mounted thereon and a tab portion protruding therefrom, the tab portion of the holder engaging the rail to pivot the rail upon movement of the rod.

4. The device of claim 3 wherein the spool has a hole therein for slidably receiving the containing rod and a set screw mechanism thereon engageable with the containing rod so as to adjustably fix the position of the spool along the containing rod.

5. The device of claim 3 wherein the rail has a parallelepiped body.

6. A method for reducing lost motion while softening sound generated by a piano, the steps of the method comprising:

providing a piano having a frame supporting a plurality of strings, a plurality of keys for selectively urging a corresponding plurality of hammers connected therewith to strike the strings, a soft pedal connected to a lifting rod assembly including an elongated lifting rod, and a pivotal hammer rail connected to another end of the lifting rod assembly adjacent the hammers and the strings;

pivotally mounting a sound softening rail to the frame adjacent the strings and above the hammers, the sound softening rail having a plurality of wedges attached thereto and extending toward the strings;

disconnecting the lifting rod assembly from the hammer rail;

removing a length of the lifting rod so as to prevent the lifting rod assembly from reaching the hammer rail;

mounting a bypass lifting rod assembly to the shortened lifting rod thereby forming an extended lifting rod assembly that extends above the hammers and is engageable with the sound softening rail so as to pivot the sound softening rail and thereby pivot the wedges attached thereto into contact with the strings when the soft pedal is depressed;

depressing the soft pedal to pivot the wedges into the strings; and maintaining the depression of the soft pedal while striking one of the keys to generate a sound from the piano.

7. The method of claim 6 wherein the strings include adjacent pairs of strings and the sound softening rail pivots the wedges so as to extend between the adjacent string of the pairs and be in simultaneous contact therewith.

8. A method for reducing lost motion while softening sound generated by a piano, the steps of the method comprising:

providing a piano having a frame supporting a plurality of strings, a plurality of keys for selectively urging a corresponding plurality of hammers connected therewith to strike the strings, a soft pedal connected to a lifting rod assembly including an elongated lifting rod, and a pivotal hammer rail connected to another end of the lifting rod assembly adjacent the hammers and the strings;

pivotally mounting a sound softening rail to the frame adjacent the strings and above the hammers, the sound softening rail having a plurality of wedges attached thereto and extending toward the strings;

disconnecting the hammer rail from the lifting rod assembly;

mounting a bypass lifting rod assembly to the lifting rod thereby forming an extended lifting rod assembly that extends above the hammers and is engageable with the sound softening rail so as to pivot the sound softening rail and thereby pivot the wedges attached thereto into contact with the strings when the soft pedal is depressed;

depressing the soft pedal to pivot the wedges into the strings; and maintaining the depression of the soft pedal while striking one of the keys to generate a sound from the piano.

9. A device for softening sounds generated by a piano having a frame supporting a plurality of strings mounted vertically thereon, a plurality of keys for selectively urging a corresponding plurality of hammers connected therewith to strike the strings, and a soft pedal having opposite ends and a central portion pivotally mounted to the frame, the device comprising:

a lifting rod assembly mounted on the frame and operatively connected with one of the ends of the soft pedal, the lifting rod assembly being free of connection with the hammers at all times and thereby being independent thereof;

an elongated sound softening rail assembly pivotally mounted on the frame and including an elongated rail having a longitudinal axis and further including at least one dampening wedge mounted on the rail so as to extend outwardly therefrom toward the strings and generally transverse to the longitudinal axis, the rail being spaced above the hammers;

the lifting rod assembly engaging the rail so as to pivot the rail about the pivot axis, thereby pivoting the dampening wedge into muting contact with at least one of the strings when the other end of the pedal is depressed;

the lifting rod assembly including a lower portion having a central longitudinal axis, an upper portion having a central longitudinal axis, and an adapter extending generally transverse to both of said central longitudinal axes and joining the upper and lower portions together such that the central longitudinal axis thereof are laterally offset from each other and the central longitudinal axis of the upper portion is spaced apart from the hammers;

the upper portion of the lifting rod assembly being detachably mounted on the lower portion by the adapter; and the lower portion of the lifting rod assembly having an upper end having a pin extending therefrom, the adapter comprising a barrel portion and a flange portion extending radially therefrom, the flange portion having a hole therein for receiving the pin and thereby mounting the adapter to the lower portion of the lifting rod assembly, the barrel being horizontally spaced from the hole and having an upwardly directed opening therein for receiving the upper portion of the lifting rod assembly.

10. A device for softening sounds generated by a piano having a frame supporting a plurality of strings mounted vertically thereon, a plurality of keys for selectively urging a corresponding plurality of hammers connected therewith to strike the strings, and a soft pedal having opposite ends and a central portion pivotally mounted to the frame, the device comprising:

a lifting rod assembly mounted on the frame and operatively connected with one of the ends of the soft pedal, the lifting rod assembly being free of connection with the hammers at all times and thereby being independent thereof;

an elongated sound softening rail assembly pivotally mounted on the frame and including an elongated rail having a longitudinal axis and further including at least one dampening wedge mounted on the rail so as to extend outwardly therefrom toward the strings and generally transverse to the longitudinal axis, the rail being spaced above the hammers;

the lifting rod assembly engaging the rail so as to pivot the rail about the pivot axis, thereby pivoting the dampening wedge into muting contact with at least one of the strings when the other end of the pedal is depressed; and the rail assembly further comprising a plurality of rigid wires, each wire attaching one of the wedges to the rail.

11. A device for softening sounds generated by a piano having a frame supporting a plurality of strings mounted vertically thereon, a plurality of keys for selectively urging a corresponding plurality of hammers connected therewith to strike the strings, and a soft pedal having opposite ends and a central portion pivotally mounted to the frame, the device comprising:

a lifting rod assembly mounted on the frame and operatively connected with one of the ends of the soft pedal, the lifting rod assembly being free of connection with the hammers at all times and thereby being independent thereof;

an elongated sound softening rail assembly pivotally mounted on the frame and including an elongated rail having a longitudinal axis and further including at least one dampening wedge mounted on the rail so as to extend outwardly therefrom toward the strings and generally transverse to the longitudinal axis, the rail being spaced above the hammers;

the lifting rod assembly engaging the rail so as to pivot the rail about the pivot axis, thereby pivoting the dampening wedge into muting contact with at least one of the strings when the other end of the pedal is depressed; and the rail having an upper surface and a lower surface and the rail assembly further comprising a guide member having a hole therein mounted on the upper surface of the rail, a containing rod extending through and being held by the hole in the guide member, a spool secured to the containing rod, and a rigid wire shank having one end attached to the spool and another end attached to the wedge.

* * * * *